US009502750B2

(12) United States Patent
Yarga et al.

(10) Patent No.: US 9,502,750 B2
(45) Date of Patent: Nov. 22, 2016

(54) ELECTRONIC DEVICE WITH REDUCED EMITTED RADIATION DURING LOADED ANTENNA OPERATING CONDITIONS

(71) Applicant: Apple Inc., Cupertino, CA (US)

(72) Inventors: Salih Yarga, Sunnyvale, CA (US); Qingxiang Li, Mountain View, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 598 days.

(21) Appl. No.: 13/855,568

(22) Filed: Apr. 2, 2013

(65) Prior Publication Data

US 2014/0292587 A1 Oct. 2, 2014

(51) Int. Cl.

| | |
|---|---|
| ***H01Q 1/24*** | (2006.01) |
| ***H01Q 9/04*** | (2006.01) |
| ***H01Q 1/38*** | (2006.01) |
| ***H01Q 5/378*** | (2015.01) |

(52) U.S. Cl.

CPC ..... *H01Q 1/243* (2013.01); *H01Q 1/245* (2013.01); *H01Q 1/38* (2013.01); *H01Q 5/378* (2015.01); *H01Q 9/0421* (2013.01)

(58) Field of Classification Search

None

See application file for complete search history.

(56) References Cited

U.S. PATENT DOCUMENTS

| | | | |
|---|---|---|---|
| 7,053,841 B2 | 5/2006 | Ponce De Leon et al. | |
| 7,345,634 B2 | 3/2008 | Ozkar et al. | |
| 8,000,737 B2 | 8/2011 | Caimi et al. | |
| 8,159,399 B2 | 4/2012 | Dorsey et al. | |
| 8,344,956 B2 | 1/2013 | Montgomery et al. | |
| 8,417,296 B2 | 4/2013 | Caballero et al. | |
| 8,432,322 B2 | 4/2013 | Amm et al. | |
| 2011/0012794 A1 | 1/2011 | Schlub et al. | |
| 2012/0214412 A1 | 8/2012 | Schlub et al. | |
| 2013/0057441 A1 | 3/2013 | Brown et al. | |
| 2013/0135157 A1* | 5/2013 | Tsou | H01Q 1/2266 343/702 |
| 2015/0372371 A1* | 12/2015 | Lagnado | H01Q 1/22 343/720 |

OTHER PUBLICATIONS

Schlub et al., U.S. Appl. No. 13/865,578, filed Apr. 18, 2013.
Caballero et al., U.S. Appl. No. 13/886,157, filed May 2, 2013.

* cited by examiner

*Primary Examiner* — Robert Karacsony
(74) *Attorney, Agent, or Firm* — Treyz Law Group, P.C.; G. Victor Treyz; Michael H. Lyons

(57) ABSTRACT

An electronic device may have an antenna for providing coverage in wireless communications bands of interest. The wireless communications bands may include a communications band at a first frequency. The antenna may have a parasitic antenna resonating element that supports a low efficiency resonance. In response to operation of the electronic device in free space, the low efficiency resonance will be located at a second frequency that is greater than the first frequency. In response to operation of the electronic device in proximity to a user's body or other external object, the antenna will be loaded and the low efficiency resonance associated with the parasitic antenna resonating element will shift to the communications band at the first frequency. The antenna may include a resonating element formed on a flexible printed circuit or a dielectric carrier such as a plastic support structure.

7 Claims, 13 Drawing Sheets

ELECTRONIC DEVICE WITH REDUCED EMITTED RADIATION DURING LOADED ANTENNA OPERATING CONDITIONS

BACKGROUND

This relates generally to electronic devices, and, more particularly, to antennas in electronic devices.

Electronic devices such as portable computers and handheld electronic devices are often provided with wireless communications capabilities. For example, electronic devices may have wireless communications circuitry to communicate using cellular telephone bands and to support communications with satellite navigation systems and wireless local area networks.

To satisfy consumer demand for small form factor wireless devices, manufacturers are continually striving to reduce the size of components that are used in these devices while providing enhanced functionality. It is generally impractical to completely shield a user of a compact handheld device from transmitted radio-frequency signals. For example, conventional cellular telephone handsets generally emit signals in the vicinity of a user's head during telephone calls. Government regulations limit radio-frequency signal powers. In particular, so-called specific absorption rate (SAR) standards are in place that impose maximum energy absorption limits on handset manufacturers. At the same time, wireless carriers require that the handsets that are used in their networks be capable of producing certain minimum radio-frequency powers so as to ensure satisfactory operation of the handsets.

The manufacturers of electronic devices such as wireless handheld devices therefore face challenges in producing devices with adequate radio-frequency signal strengths that are compliant with applicable government regulations.

It would therefore be desirable to be able to provide improved electronic device antennas.

SUMMARY

An electronic device may have an antenna for providing coverage in wireless communications bands of interest. The wireless communications bands may include a communications band at a first frequency. The antenna may have a parasitic antenna resonating element that supports a resonance associated with lowered antenna efficiency.

When operating the electronic device in free space, the low efficiency resonance is located at a second frequency that is greater than the first frequency. Wireless communications signals may therefore be transmitted and received with the antenna in the communications band at the first frequency without reduction in the efficiency of the antenna due to the resonance from the parasitic antenna resonating element. When operating the electronic device in proximity to a user's body or other external object, the antenna will be loaded. This will cause the low efficiency resonance associated with the parasitic antenna resonating element to shift to the communications band at the first frequency, thereby reducing transmitted radio-frequency signal power and helping to ensure that regulatory limits on transmitted power levels are satisfied.

The antenna may include a resonating element formed on a flexible printed circuit or a dielectric carrier such as a plastic support structure. Antenna ground for the antenna may be formed by a metal housing for the electronic device. A capacitor or inductor may be used to couple the parasitic antenna resonating element to the antenna ground. The antenna may have a curved shape overlapping an inactive display area and an antenna window in the housing. Capacitive proximity sensor circuitry may be coupled to the antenna.

Further features of the invention, its nature and various advantages will be more apparent from the accompanying drawings and the following detailed description of the preferred embodiments.

DETAILED DESCRIPTION

Figure 1:
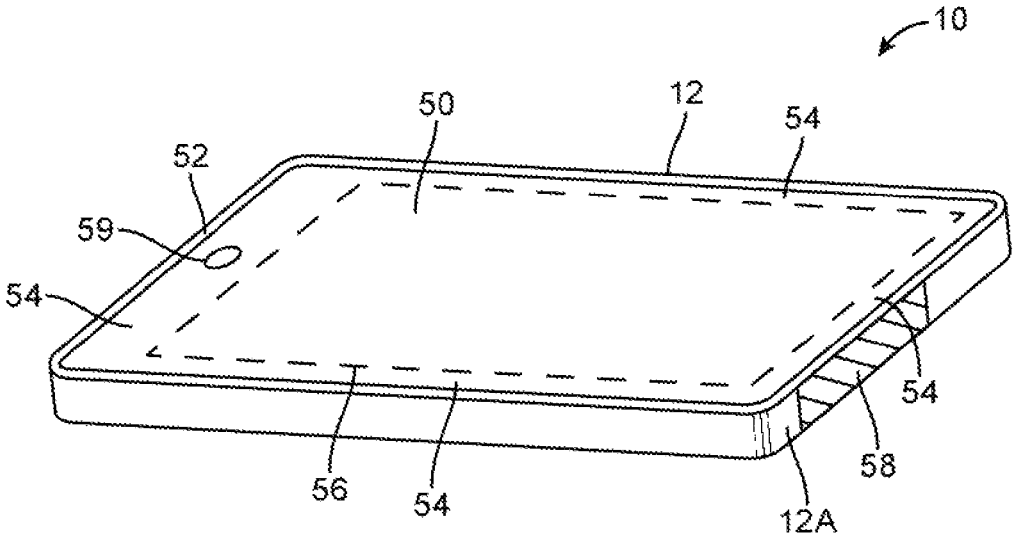
FIG. 1 is a front perspective view of an illustrative electronic device of the type that may be provided with antenna structures in accordance with an embodiment of the present invention.

Electronic devices may be provided with antennas, and other electronic components. An illustrative electronic device in which electronic components such as antenna structures may be used is shown in FIG. 1. As shown in FIG. 1, device 10 may have a display such as display 50. Display 50 may be mounted on a front (top) surface of device 10 or may be mounted elsewhere in device 10. Device 10 may have a housing such as housing 12. Housing 12 may have curved, angled, or vertical sidewall portions that form the edges of device 10 and a relatively planar portion that forms the rear surface of device 10 (as an example). Housing 12 may also have other shapes, if desired.

Housing 12 may be formed from conductive materials such as metal (e.g., aluminum, stainless steel, etc.), carbon-fiber composite material or other fiber-based composites, glass, ceramic, plastic, or other materials. A radio-frequency-transparent window such as window 58 may be formed in housing 12 (e.g., in a configuration in which the rest of housing 12 is formed from conductive structures). Window 58 may be formed from plastic, glass, ceramic, or other dielectric material. Antenna structures, and, if desired, proximity sensor structures for use in determining whether external objects are present in the vicinity of the antenna structures may be formed in the vicinity of window 58. If desired, antenna structures and proximity sensor structures may be mounted behind a dielectric portion of housing 12 (e.g., in a configuration in which housing 12 is formed from plastic or other dielectric material).

Device 10 may have user input-output devices such as button 59. Display 50 may be a touch screen display that is used in gathering user touch input. The surface of display 50 may be covered using a display cover layer such as a planar cover glass member or a clear layer of plastic. The central portion of display 50 (shown as region 56 in FIG. 1) may be an active region that displays images and that is sensitive to touch input. Peripheral portions of display 50 such as region 54 may form an inactive region that is free from touch sensor electrodes and that does not display images.

An opaque masking layer such as opaque ink or plastic may be placed on the underside of display 50 in peripheral region 54 (e.g., on the underside of the display cover layer). This layer may be transparent to radio-frequency signals. The conductive touch sensor electrodes and display pixel structures and other conductive structures in region 56 tend to block radio-frequency signals. However, radio-frequency signals may pass through the display cover layer (e.g., through a cover glass layer) and opaque masking layer in inactive display region 54 (as an example). Radio-frequency signals may also pass through antenna window 58 or dielectric housing walls in a housing formed from dielectric material. Lower-frequency electromagnetic fields may also pass through window 58 or other dielectric housing structures, so capacitance measurements for a proximity sensor may be made through antenna window 58 or other dielectric housing structures, if desired.

With one suitable arrangement, housing 12 may be formed from a metal such as aluminum. Portions of housing 12 in the vicinity of antenna window 58 may be used as antenna ground. Antenna window 58 may be formed from a dielectric material such as polycarbonate (PC), acrylonitrile butadiene styrene (ABS), a PC/ABS blend, or other plastics (as examples). Window 58 may be attached to housing 12 using adhesive, fasteners, or other suitable attachment mechanisms. To ensure that device 10 has an attractive appearance, it may be desirable to form window 58 so that the exterior surfaces of window 58 conform to the edge profile exhibited by housing 12 in other portions of device 10. For example, if housing 12 has straight edges 12A and a flat bottom surface, window 58 may be formed with a right-angle bend and vertical sidewalls. If housing 12 has curved edges 12A, window 58 may have a similarly curved exterior surface along the edge of device 10.

Figure 2:
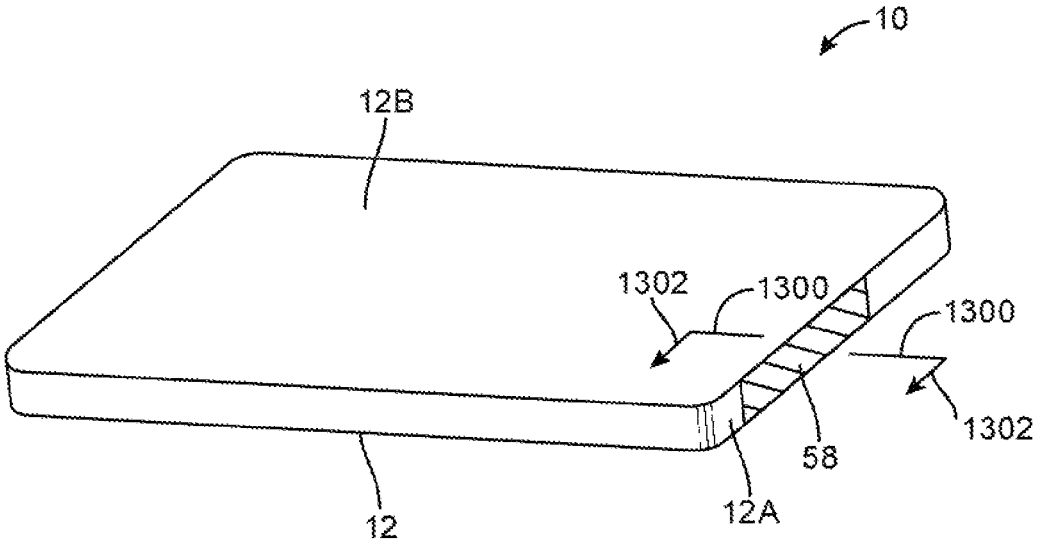
FIG. 2 is a rear perspective view of an illustrative electronic device such as the electronic device of FIG. 1 in accordance with an embodiment of the present invention.

FIG. 2 is a rear perspective view of device 10 of FIG. 1 showing how device 10 may have a relatively planar rear surface 12B and showing how antenna window 58 may be rectangular in shape with portions that match the shape of housing edges 12A. Antenna window 58 may have curved walls, planar walls, or walls of other shapes, if desired. Display 50 may be mounted on the opposing front surface of housing 12 of device 10.

Figure 3:
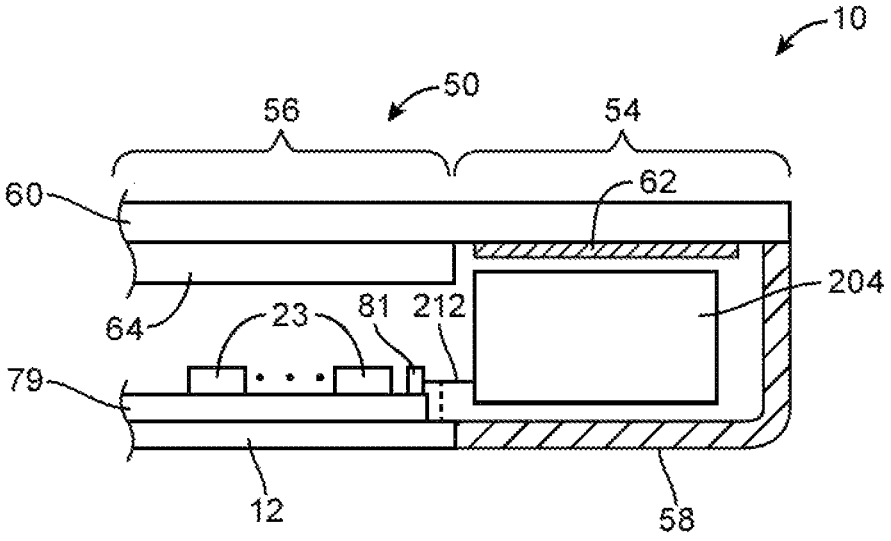
FIG. 3 is a cross-sectional side view of a portion of an electronic device having antenna structures in accordance with an embodiment of the present invention.

A cross-sectional view of device 10 taken along line 1300 of FIG. 2 and viewed in direction 1302 is shown in FIG. 3. As shown in FIG. 3, antenna structures 204 may be mounted within device 10 in the vicinity of antenna window 58. Structures 204 may include conductive material that serves as an antenna resonating element for an antenna. The antenna may be fed using transmission line 212. Transmission line 212 may have a positive signal conductor that is coupled to a positive antenna feed terminal (e.g., a feed terminal associated with a metal antenna resonating element trace on a dielectric support in structures 204) and a ground signal conductor that is coupled to a ground antenna feed terminal (i.e., antenna ground formed from conductive ground traces on a dielectric carrier in antenna structures 204 and/or grounded structures such as grounded portions of housing 12).

The antenna resonating element formed from structures 204 may be based on any suitable antenna resonating element design (e.g., structures 204 may form a patch antenna resonating element, a single arm inverted-F antenna structure, a dual-arm inverted-F antenna structure, other suitable multi-arm or single arm inverted-F antenna structures, a closed and/or open slot antenna structure, a loop antenna structure, a monopole, a dipole, a planar inverted-F antenna structure, a hybrid of any two or more of these designs, etc.). Configurations in which antenna structures 204 form an inverted-F antenna are sometimes described herein as an example.

Housing 12 may serve as antenna ground for an antenna formed from structure 204 and/or other conductive structures within device 10 and antenna structures 204 may serve as ground (e.g., conductive components, traces on printed circuits, etc.).

Structures 204 may include patterned conductive structures such as patterned metal structures. The patterned conductive structures may, if desired, be supported by a dielectric carrier. The conductive structures may be formed from a coating, from metal traces on a flexible printed circuit, or from metal traces formed on a plastic carrier using laser-processing techniques or other patterning techniques. Structures 204 may also be formed from stamped metal foil or other metal structures. In configurations for antenna structures 204 that include a dielectric carrier, metal layers may be formed directly on the surface of the dielectric carrier and/or a flexible printed circuit that includes patterned metal traces may be attached to the surface of the dielectric carrier. If desired, conductive material in structures 204 may also form one or more proximity sensor capacitor electrodes.

During operation of the antenna formed from structures 204, radio-frequency antenna signals can be conveyed through dielectric window 58. Radio-frequency antenna signals associated with structures 204 may also be conveyed through a display cover member such as cover layer 60. Display cover layer 60 may be formed from one or more clear layers of glass, plastic, or other materials. Display 50 may have an active region such as region 56 in which cover layer 60 has underlying conductive structure such as display module 64. The structures in display module 64 such as touch sensor electrodes and active display pixel circuitry may be conductive and may therefore attenuate radio-frequency signals. In region 54, however, display 50 may be inactive (i.e., module 64 may be absent). An opaque masking layer such as plastic or ink 62 may be formed on the underside of transparent cover glass 60 in region 54 to block antenna structures 204 from view by a user of device 10. Opaque material 62 and the dielectric material of cover layer 60 in region 54 may be sufficiently transparent to radio-frequency signals that radio-frequency signals can be conveyed through these structures during operation of device 10.

Device 10 may include one or more internal electrical components such as components 23. Components 23 may include storage and processing circuitry such as microprocessors, digital signal processors, application specific integrated circuits, memory chips, and other control circuitry. Components 23 may be mounted on one or more substrates such as substrate 79 (e.g., rigid printed circuit boards such as boards formed from fiberglass-filled epoxy, flexible printed circuits, molded plastic substrates, etc.). Components 23 may include input-output circuitry such as sensor circuitry (e.g., capacitive proximity sensor circuitry), wireless circuitry such as radio-frequency transceiver circuitry (e.g., circuitry for cellular telephone communications, wireless local area network communications, satellite navigation system communications, near field communications, and other wireless communications), amplifier circuitry, and other circuits. Connectors such as connector 81 may be used in interconnecting circuitry 23 to communications paths such as transmission line path 212.

Conductive structures for antenna structures 204 may be supported by a dielectric carrier. Antenna structures 204 may, for example, have conductive structures such as metal structures that are supported by a solid plastic member, a hollow plastic member, or other dielectric carrier structures. The conductive structures may be metal traces that are formed on the surface of a dielectric carrier using laser-based deposition techniques, physical vapor deposition techniques, electrochemical deposition, blanket metal deposition followed by photolithographic patterning, ink-jet printing deposition techniques, etc. The conductive structures may also be metal traces that are formed on a rigid printed circuit board (e.g., a printed circuit board formed from a substrate such as fiberglass-filled epoxy), metal traces that are formed on a flexible printed circuit (e.g., a printed circuit formed from a layer of polyimide or a sheet of other polymer) that is mounted on a dielectric carrier (e.g., a carrier formed from molded plastic or other material), may be other metal structures supported by a carrier (e.g., patterned metal foil), or may be other conductive structures.

Dielectric carriers for supporting metal antenna traces or a flexible printed circuit or other structure that includes metal antenna traces may be formed from a dielectric material such as glass, ceramic, or plastic. As an example, a dielectric carrier for antenna(s) in device 10 may be formed from plastic parts that are molded and/or machined into a desired shape such as a rectangular prism shape (rectangular box shape), a three-dimensional solid shape with one or more curved surfaces (e.g., a box shape with a curved outer surface that matches a corresponding curved housing edge 12A), or other shapes. In general, dielectric carrier shapes such as box or prism shapes with different numbers of sides and/or one or more curved surfaces or other three-dimensional carrier shapes may be used for antenna structures 204. The illustrative configuration of FIG. 3 in which antenna structures 204 have a rectangular cross-sectional shape is merely illustrative.

Figure 4:
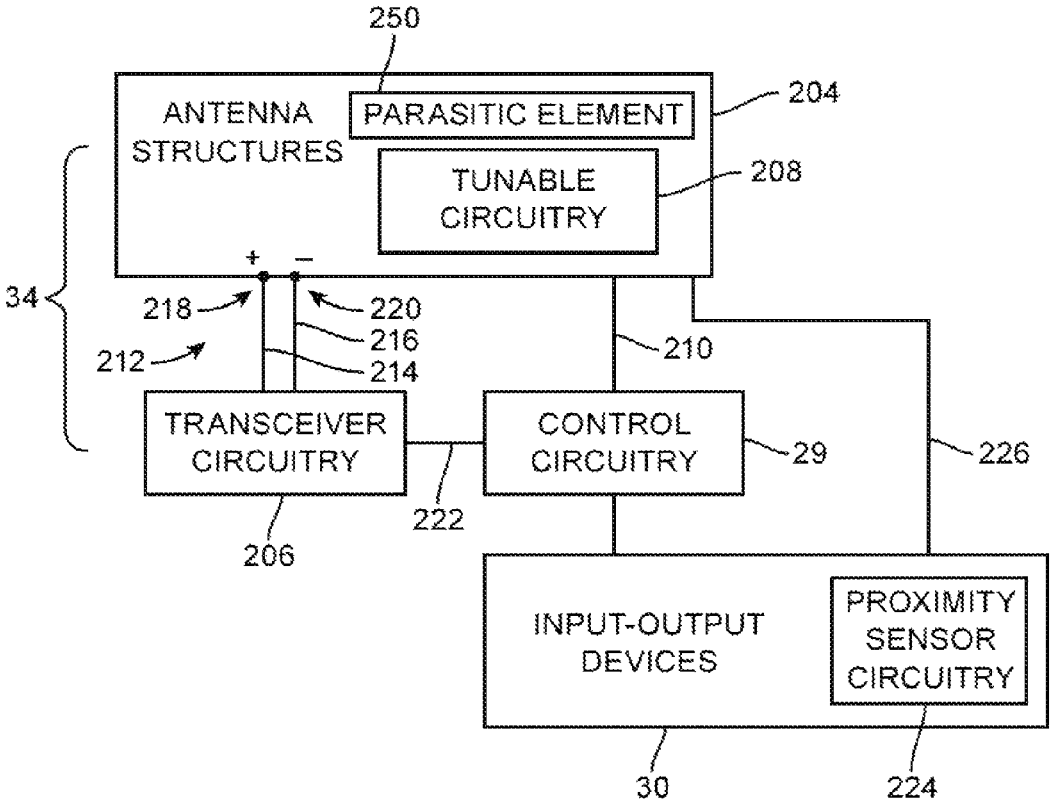
FIG. 4 is a diagram of illustrative antenna structures and other wireless circuitry in accordance with an embodiment of the present invention.

A schematic diagram of an illustrative configuration that may be used for electronic device 10 is shown in FIG. 4. As shown in FIG. 4, electronic device 10 may include control circuitry 29. Control circuitry 29 may include storage and processing circuitry for controlling the operation of device 10. Control circuitry 29 may, for example, include storage such as hard disk drive storage, nonvolatile memory (e.g., flash memory or other electrically-programmable-read-only memory configured to form a solid state drive), volatile memory (e.g., static or dynamic random-access-memory), etc. Control circuitry 29 may include processing circuitry based on one or more microprocessors, microcontrollers, digital signal processors, baseband processors, power management units, audio codec chips, application specific integrated circuits, etc.

Control circuitry 29 may be used to run software on device 10, such as operating system software and application software. Using this software, control circuitry 29 may, for example, transmit and receive wireless data, tune antennas to cover communications bands of interest, and perform other functions related to the operation of device 10.

Input-output devices 30 may be used to allow data to be supplied to device 10 and to allow data to be provided from device 10 to external devices. Input-output circuitry 30 may include communications circuitry such as wired communications circuitry. Device 10 may also use wireless circuitry such as transceiver circuitry 206 and antenna structures 204 to communicate over one or more wireless communications bands.

Input-output devices 30 may also include input-output components with which a user can control the operation of device 10. A user may, for example, supply commands through input-output devices 30 and may receive status information and other output from device 10 using the output resources of input-output devices 30.

Input-output devices 30 may include proximity sensor circuitry 224 such as capacitive proximity sensor circuitry that uses portions of antenna structures 204 or other conductive structures in device 10 as capacitive proximity sensor electrodes. Proximity sensor circuitry 224 may be coupled to proximity sensor electrode structures in antenna structures 204 or elsewhere in device 10 using paths such as path 226. A capacitive proximity sensor may, for example, be used to determine when a user's body or other external object is in the vicinity of antenna structures 204. Proximity sensors for device 10 may also be formed using light-based proximity sensor structures, acoustic proximity sensor structures, etc.

Input-output devices 30 may also include sensors and status indicators such as an ambient light sensor, a temperature sensor, a pressure sensor, a magnetic sensor, an accelerometer, and light-emitting diodes and other components for gathering information about the environment in which device 10 is operating and providing information to a user of device 10 about the status of device 10. Audio components in devices 30 may include speakers and tone generators for presenting sound to a user of device 10 and microphones for gathering user audio input.

Devices 30 may include one or more displays such as display 50 of FIG. 1. Displays may be used to present images for a user such as text, video, and still images. Sensors in devices 30 may include a touch sensor array that is formed as one of the layers in display 14. During operation, user input may be gathered using buttons and other input-output components in devices 30 such as touch pad sensors, buttons, joysticks, click wheels, scrolling wheels, touch sensors such as a touch sensor array in a touch screen display or a touch pad, key pads, keyboards, vibrators, cameras, and other input-output components.

Wireless communications circuitry 34 may include radio-frequency (RF) transceiver circuitry such as transceiver circuitry 206 that is formed from one or more integrated circuits, power amplifier circuitry, low-noise input amplifiers, passive RF components, one or more antennas such as antenna structures 204, and other circuitry for handling RF wireless signals. Wireless signals can also be sent using light (e.g., using infrared communications).

Wireless communications circuitry 34 may include radio-frequency transceiver circuits for handling multiple radio-frequency communications bands. For example, circuitry 34 may include transceiver circuitry 206 for handling cellular telephone communications, wireless local area network signals, and satellite navigation system signals such as signals at 1575 MHz from satellites associated with the Global Positioning System. Transceiver circuitry 206 may handle 2.4 GHz and 5 GHz bands for WiFi® (IEEE 802.11) communications or other wireless local area network communications and may handle the 2.4 GHz Bluetooth® communications band. Circuitry 206 may use cellular telephone transceiver circuitry for handling wireless communications in cellular telephone bands such as the bands in the range of 700 MHz to 2.7 GHz (as examples).

Wireless communications circuitry 34 can include circuitry for other short-range and long-range wireless links if desired. For example, wireless communications circuitry 34 may include wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles. Wireless communications circuitry 34 may also include circuitry for handing near field communications.

Wireless communications circuitry 34 may include antenna structures 204. Antenna structures 204 may include one or more antennas. Antenna structures 204 may include inverted-F antennas, patch antennas, loop antennas, monopoles, dipoles, single-band antennas, dual-band antennas, antennas that cover more than two bands, or other suitable antennas. Configurations in which at least one antenna in device 10 is formed from an inverted-F antenna structure such as a dual band inverted-F antenna are sometimes described herein as an example.

If desired, antenna structures 204 may be provided with one or more tunable components or other tunable circuitry. Discrete components such as capacitors, inductors, and resistors may be incorporated into the tunable circuitry. Capacitive structures, inductive structures, and resistive structures may also be formed from patterned metal structures (e.g., part of an antenna).

If desired, antenna structures 204 may be provided with adjustable circuits such as tunable circuitry 208 of FIG. 4. Tunable circuitry 208 may be controlled by control signals from control circuitry 29. For example, control circuitry 29 may supply control signals to tunable circuitry 208 via control path 210 during operation of device 10 whenever it is desired to tune antenna structures 204 to cover a desired communications band. Path 222 may be used to convey data between control circuitry 29 and wireless communications circuitry 34 (e.g., when transmitting wireless data or when receiving and processing wireless data).

Transceiver circuitry 206 may be coupled to antenna structures 204 by signal paths such as signal path 212. Signal path 212 may include one or more transmission lines. As an example, signal path 212 of FIG. 4 may be a transmission line having a positive signal conductor such as line 214 and a ground signal conductor such as line 216. Lines 214 and 216 may form parts of a coaxial cable or a microstrip transmission line (as examples). A matching network formed from components such as inductors, resistors, and capacitors may be used in matching the impedance of antenna structures 204 to the impedance of transmission line 212. Matching network components may be provided as discrete components (e.g., surface mount technology components) or may be formed from housing structures, printed circuit board structures, traces on plastic supports, etc. Components such as these may also be used in forming fixed circuit elements such as a fixed capacitor coupled to an antenna resonating element trace in antenna structures 204 and/or a tunable element such as a tunable capacitor in tunable circuitry 208 in antenna structures 204.

Transmission line 212 may be coupled to antenna feed structures associated with antenna structures 204. As an example, antenna structures 204 may form an inverted-F antenna having an antenna feed with a positive antenna feed terminal such as terminal 218 and a ground antenna feed terminal such as ground antenna feed terminal 220. Positive transmission line conductor 214 may be coupled to positive antenna feed terminal 218 and ground transmission line conductor 216 may be coupled to ground antenna feed terminal 220. Other types of antenna feed arrangements may be used if desired. The illustrative feeding configuration of FIG. 4 is merely illustrative.

Tunable circuitry 208 may be formed from one or more tunable circuits such as circuits based on capacitors, resistors, inductors, and switches. Tunable circuitry 208 may be implemented using discrete components mounted to a printed circuit such as a rigid printed circuit board (e.g., a printed circuit board formed from glass-filled epoxy) or a flexible printed circuit formed from a sheet of polyimide or a layer of other flexible polymer, a plastic carrier, a glass carrier, a ceramic carrier, or other dielectric substrate. As an example, tunable circuitry 208 may be coupled to a dielectric carrier of the type that may be used in supporting antenna resonating element traces for antenna structures 204 (FIG. 3). Fixed circuit components (e.g., a fixed capacitor or inductor coupled to metal traces in antenna structures 204) may also be formed using these arrangements. If desired, antenna structures 204 may omit tunable circuitry 208 (i.e., antenna structures 204 may be implemented using only fixed components).

Wireless carriers typically require that wireless devices that are to be used in their networks pass certification testing. Typical tests involve ascertaining whether a device under test can satisfy wireless performance criteria when tested in free space. Government regulations impose limits on emitted radiation levels from devices such as device 10. These regulations, which are sometimes referred to as specific absorption rate (SAR) standards, impose maximum energy absorption limits on devices that are used in the vicinity of a user's body. There is therefore a tension between ensuring adequate wireless performance to satisfy carrier requirements and satisfying SAR standards.

To provide antenna structures 204 with the ability to cover communications frequencies of interest with desired performance while satisfying SAR limits when a device is placed in the vicinity of an external object such as a user's head or other body part, antenna structures 204 may be provided with an antenna resonating element and near-field coupled parasitic antenna structures such parasitic antenna resonating element 250. Parasitic antenna resonating element 250 may be electromagnetically coupled to the antenna resonating element through near field coupling, whereas the antenna resonating element may be fed using an antenna feed such as the feed formed from positive antenna feed terminal 218 and ground antenna feed 220. The presence of parasitic antenna resonating element 250 may help reduce emitted radiation levels in a given communications band when device 10 is operated in the vicinity of an external object that loads the antenna(s) in device 10 without adversely affecting the free space performance of device 10 in the given communications band. The given communications band may be, for example, a cellular telephone band.

It is often most challenging to satisfy SAR standards when operating a device in high frequency communications bands (e.g., at high band cellular telephone frequencies). With one suitable arrangement, parasitic antenna resonating element 250 may be configured to resonate at a frequency range just above these high communications bands of interest for antenna structures 204. The resonant mode supported by the parasitic antenna resonating element may exhibit a lower efficiency than that of the antenna resonating element due to current concentration in the parasitic element, so the presence of the parasitic antenna resonating element in the antenna may reduce antenna performance at the resonant frequency associated with the parasitic antenna resonating element.

The position of the parasitic antenna resonating element resonance depends on antenna loading. During normal free space operation in which the antenna is unloaded by the presence of a user's head or other external object, the resonant frequency of the parasitic antenna resonating element (and therefore the frequency of reduced antenna efficiency) is generally located outside of the operating frequencies of device 10 (i.e., above the highest cellular telephone bands of interest). During operation in the vicinity of a user's head or other external object that loads the antenna, the resonant frequency of the parasitic antenna resonating element (and therefore the frequency of reduced antenna efficiency) will be shifted to lower frequencies, overlapping the highest cellular telephone bands of interest. Because of the reduced efficiency of the antenna during loaded operating conditions, less radiation will be emitted from device 10 whenever device 10 is operated in proximity to the user's body, thereby helping to ensure that device 10 satisfies SAR limits.

Figure 5:
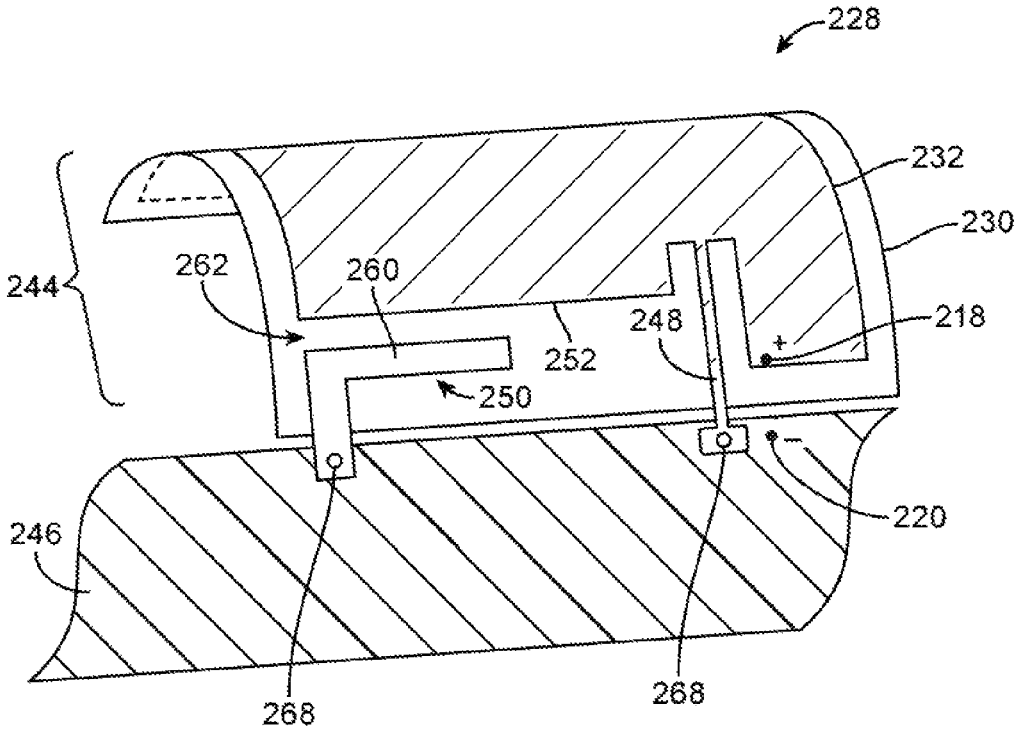
FIG. 5 is a perspective view of an antenna with a parasitic antenna resonating element that may be used in an electronic device in accordance with an embodiment of the present invention.

FIG. 5 is a perspective view of an illustrative antenna of the type that may be used in an electronic device such as device 10. Antenna 228 has antenna resonating element 244 and antenna ground 246. Antenna 228 also has parasitic antenna resonating element 250. Antenna resonating element 244 and parasitic antenna resonating element 250 may be formed from metal traces (see, e.g., metal trace 232 for element 244) on curved dielectric support 230 (as an example). Dielectric support 230 may be a flexible printed circuit (as an example). Antenna 228 may have an inverted-F configuration having main resonating element arm 252, short circuit path 248 to couple main resonating element arm 252 to antenna ground 246, and an antenna feed having positive antenna feed terminal 218 coupled to arm 252 and ground antenna feed terminal 220 coupled to antenna ground 246.

Antenna 228 may, if desired, have a curved shape of the type shown in FIG. 5. This type of layout may allow antenna 228 to be mounted within the edge of housing 12 in a configuration of the type shown in FIG. 3 where part of the antenna overlaps inactive region 54 of display 50 and part of the antenna overlaps antenna window 58. Other layouts for antenna 228 may be used, if desired.

Antenna ground 246 may be formed from housing 12 and/or other conductive structures in device 10. Antenna resonating element trace 232 and metal traces for parasitic antenna resonating element 250 may be formed from patterned metal traces in a flexible printed circuit that is supported by a dielectric support structure or may be formed from patterned metal traces on the surface of a molded plastic member or other dielectric carrier. Laser processing techniques may be used in forming metal traces on plastic carriers, if desired.

Antenna 228 may be fed using an antenna feed that includes positive antenna feed terminal 218 coupled to arm 252 and ground antenna feed terminal 220 on antenna ground 246. Parasitic antenna resonating element 250 may be located at the opposing end of arm 252. As shown in FIG. 5, parasitic antenna resonating element 250 may have an L shape (as an example). Elongated portion 260 of L-shaped parasitic resonating element 250 may run parallel to the edge of trace 232 and may be separated from trace 232 of antenna resonating element 244 by a dielectric gap such as gap 262.

Short circuit path 248 may couple antenna resonating element 244 to antenna ground 246 at a location between the antenna feed and parasitic antenna resonating element 250 (as an example). Electrical connections 268 such as welds, solder joints, screws or other structures may be used in coupling parasitic antenna resonating element 250 and short circuit path 248 to ground 246.

There may be one or more layers of metal traces such as the metal traces of element 250 and traces 232 in antenna 228. If desired, traces 232 may be used in forming capacitive proximity sensor electrodes for a capacitive proximity sensor. Proximity sensor circuitry 224 (FIG. 4) may be coupled to metal traces 232 using path 226 (FIG. 4) via a pair of inductors or other signal isolating circuitry for preventing radio-frequency antenna signals from antenna resonating element trace 232 from reaching circuitry 224 of FIG. 4.

Figure 6:
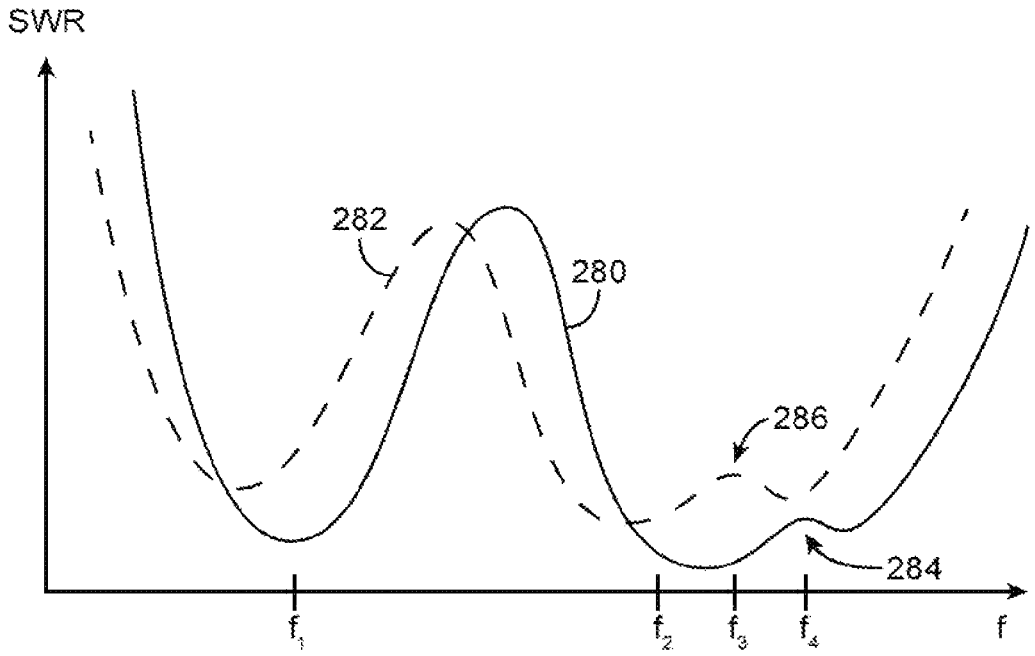
FIG. 6 is a graph in which antenna performance (standing-wave ratio) for an antenna of the type shown in FIG. 5 has been plotted as a function of operating frequency for loaded and unloaded operating conditions in accordance with an embodiment of the present invention.

FIG. 6 is a graph in which antenna performance (standing wave ratio SWR) has been plotted as a function of operating frequency for an illustrative antenna such as antenna 228 of FIG. 5. As shown in FIG. 6, illustrative antenna 228 of FIG. 5 has been configured to operate in low frequency band f1, middle frequency band f2, and high frequency band f3. The communications bands associated with frequencies f1, f2, and f3 may be, for example, cellular telephone bands at frequencies between about 700 MHz to 2700 MHz (as examples).

Solid line curve 280 corresponds to operation of antenna 228 in free space when antenna 228 is not loaded due to the presence of a user's head or other external object in proximity to device 10. Dashed line curve 282 corresponds to operation of antenna 228 when device 10 and antenna 228 have been placed in the vicinity of a user's head or other external object that loads antenna 228. Due to the presence of parasitic antenna resonating element 250 (FIG. 5), curve 280 is characterized by a reduced-efficiency resonance such as resonance 284 (i.e., a resonant mode associated with currents flowing within parasitic antenna resonating element 250).

During normal unloaded operation of antenna 228, resonance 284 lies at a frequency f4 that is above the frequencies associated with desired operation of device 10 (i.e., signals at frequency f4 lie above the communications bands at frequencies f2 and f3). The presence of parasitic antenna resonating element 250 in antenna 228 and the resulting parasitic resonant mode that is supported by the parasitic antenna resonating element will therefore not adversely affect antenna performance during unloaded operations.

When device 10 and antenna 228 are brought into proximity of an external object such as a user's head or other body part, antenna 228 will be loaded by the presence of the external object. This will cause the response curve for antenna 228 to shift from that shown by curve 280 to that shown by curve 282. As shown in FIG. 6, for example, resonance 284 will shift to the position shown by resonance 286, overlapping high frequency communications bands such as the high frequency communications bands at frequencies f2 and f3. The overlap of resonance 286 with the communications bands at f2 and f3 will decrease antenna efficiency in the bands at frequencies f2 and f3. Because antenna efficiency is decreased in the bands at frequencies f2 and f3 when antenna 228 is loaded, the amount of emitted power at frequencies f2 and f3 will be reduced when antenna 228 is loaded, thereby helping to ensure that SAR regulations and SAR compliance tests (which are performed when device 10 is in the vicinity of a phantom) are satisfied.

Figure 7:
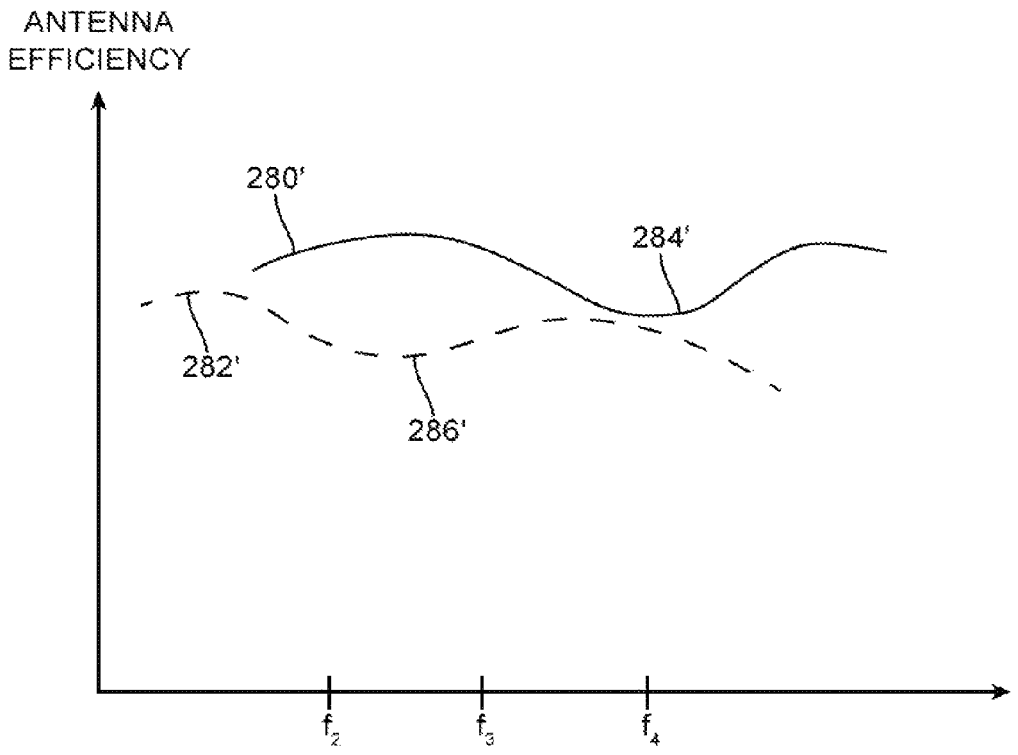
FIG. 7 is a graph in which antenna efficiency for an antenna of the type shown in FIG. 5 has been plotted as a function of operating frequency for loaded and unloaded operating conditions in accordance with an embodiment of the present invention.

The graph of FIG. 7 shows how antenna efficiency in the communications bands at frequencies f2 and f3 decreases when antenna 228 is loaded due to operation of device 10 at the head of a user or in the vicinity of other external objects that load antenna 228. Curve 280' corresponds to unloaded operation, where antenna efficiency at frequencies f2 and f3 is relatively high, because parasitic resonance 284' lies out of band. Curve 282' corresponds to loaded operation, where parasitic resonance 284' has shifted to the position shown by resonance 286' and antenna efficiency has been reduced.

Figure 8:
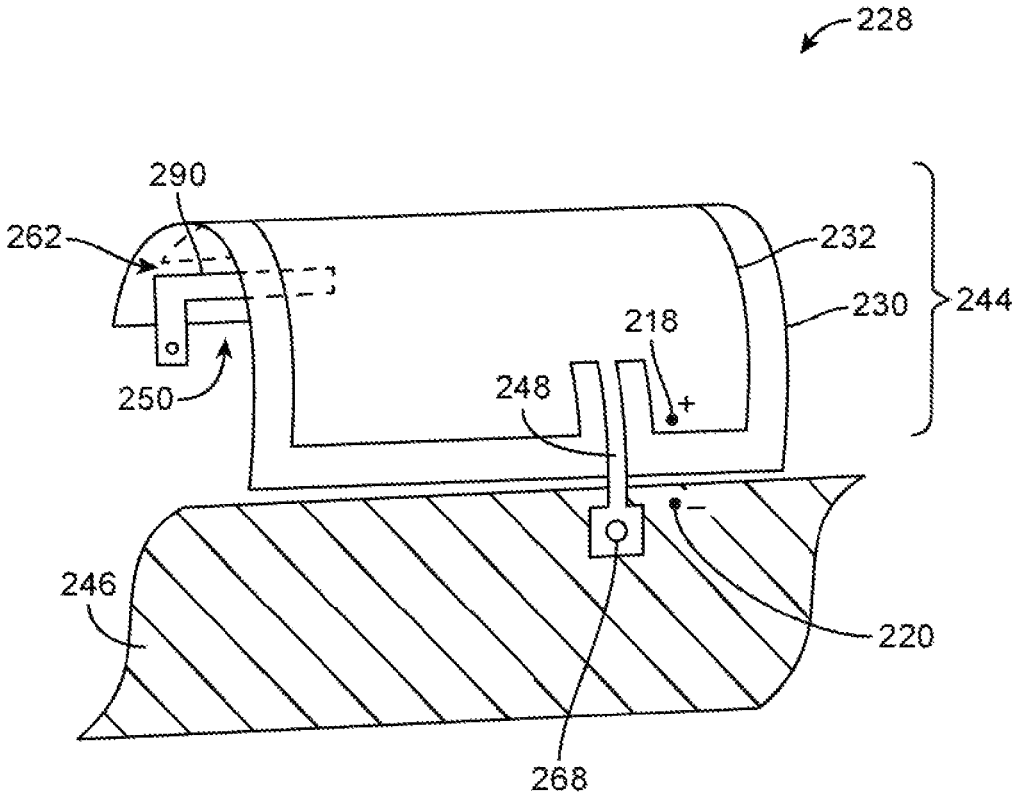
FIG. 8 is a perspective view of an illustrative antenna with a parasitic element mounted to the opposing side of a flexible printed circuit substrate from an antenna resonating element in accordance with an embodiment of the present invention.

As shown in FIG. 8, parasitic antenna resonating element 250 may, if desired, be implemented using traces 290 on the opposing side of a flexible printed circuit substrate or other dielectric carrier 230 from traces 232. Gap 262 may be sufficiently small to allow traces 290 to be electromagnetically near field coupled to traces 232 of antenna resonating element 244.

Figure 9:
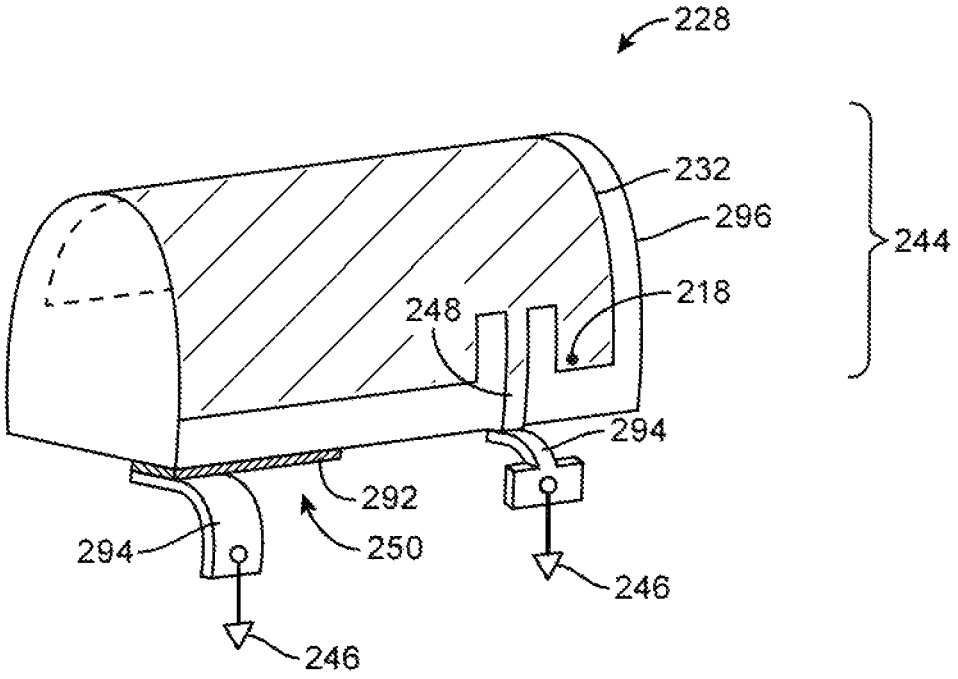
FIG. 9 is a perspective view of an illustrative antenna with a parasitic element formed from metal traces on a plastic carrier substrate in accordance with an embodiment of the present invention.

FIG. 9 is a perspective view of antenna 228 in a configuration in which antenna resonating element 244 has been formed from metal traces 232 that have been formed on the surface of a hollow or solid molded plastic member or other dielectric carrier 296. In this type of configuration, it may be desirable to form parasitic antenna resonating element 250 from metal traces such as metal traces 292 that have been formed directly on carrier 296. Laser processing techniques such as those involving light illumination to selectively activate surface regions on carrier 296 followed by electroplating may be used in forming patterned metal traces such as metal traces 292 and 232 of FIG. 9. Metal traces in flexible printed circuits 294 or other conductive paths may be used in coupling parasitic element 250 and short circuit path 248 to antenna ground 246.

Figure 10:
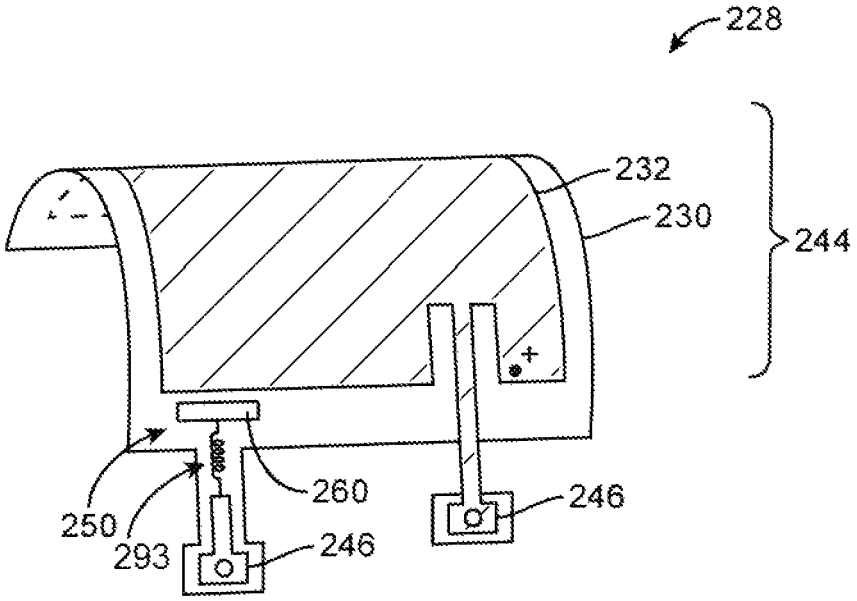
FIG. 10 is a perspective view of an illustrative antenna in which a parasitic element is coupled to ground using a circuit element such as an inductor in accordance with an embodiment of the present invention.

If desired, an electrical component such as inductor 293 may be coupled between parasitic antenna resonating element trace 260 in parasitic antenna resonating element 250 and antenna ground 246, as shown in FIG. 10. With this type of hybrid parasitic antenna element configuration, the length of elongated parasitic antenna resonating element trace 260 may be reduced (relative to the length of trace 260 of FIG. 5) for a given parasitic antenna resonating element resonance frequency.

Figure 11:
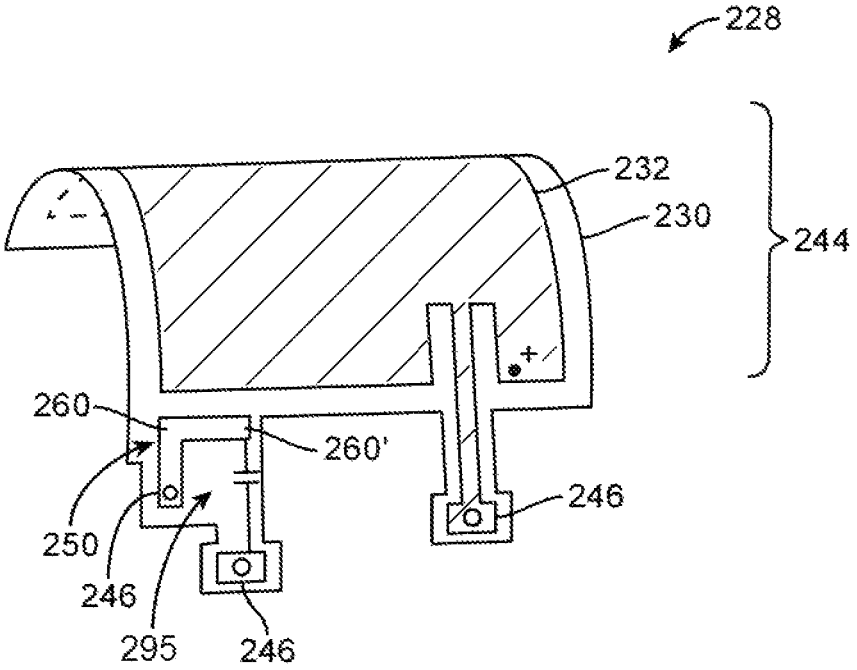
FIG. 11 is a perspective view of an illustrative antenna in which a parasitic element is coupled to ground using a circuit element such as a capacitor in accordance with an embodiment of the present invention.

FIG. 11 is a perspective view of antenna 228 showing an illustrative configuration that may be used for antenna 228 in which an electrical component such as capacitor 295 has been coupled between parasitic antenna resonating element trace 260 in parasitic antenna resonating element 250 (i.e., tip portion 260' of trace 260) and antenna ground 246. The opposing end of trace 260 may be coupled to ground 246. As with the configuration of FIG. 10, the configuration of FIG. 11 allows the length of elongated parasitic antenna resonating element trace 260 to be reduced relative to the length of trace 260 of FIG. 5 while maintain a desired parasitic antenna resonating element resonance frequency.

Figure 12:
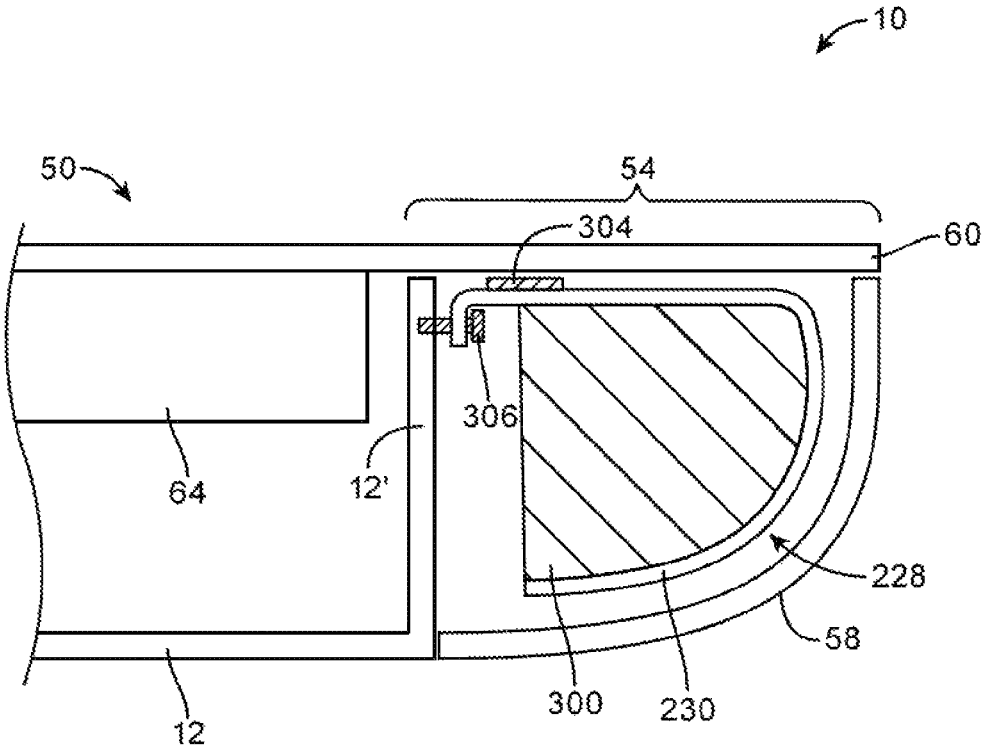
FIGS. 12 and 13 are cross-sectional side views of illustrative electronic device antennas mounted in an electronic device in accordance with an embodiment of the present invention.
Figure 13:
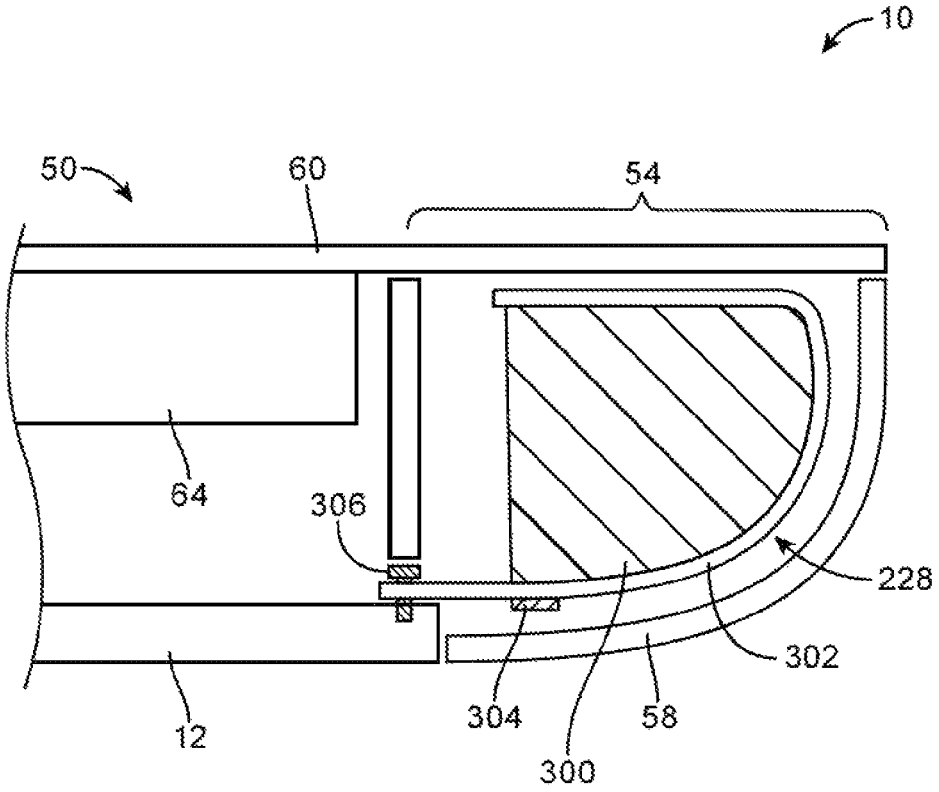

FIG. 12 is a cross-sectional side view of device 10 showing how antenna 228 may be formed from a flexible printed circuit substrate (flexible printed circuit 230) on dielectric carrier 300. Component 304 (e.g., inductor 292 or capacitor 294) may be coupled to traces on flexible printed circuit 230. A conductive structure such as screw 306 may be used to electrically connect traces on printed circuit 230 to antenna ground (e.g., portion 12' of metal housing 12). As shown in the illustrative configuration of FIG. 13, screw 306 or other electrical connection structures may be used to couple traces on printed circuit 302 to housing 12. Using configurations of the type shown in FIGS. 12 and 13, antenna 228 may be curved so as to overlap inactive portion 54 of display 50 and antenna window 58, allowing antenna signals to be transmitted and received through antenna window 58 and/or inactive portion 54 of display 50 (e.g., area 54 in display cover layer 60).

The foregoing is merely illustrative of the principles of this invention and various modifications can be made by those skilled in the art without departing from the scope and spirit of the invention.

What is claimed is:

1. An antenna operable in a communications band at a first frequency, comprising:

an antenna ground;

antenna resonating element, wherein the antenna resonating element comprises an inverted-F antenna resonating element;

a parasitic antenna resonating element, wherein the parasitic antenna resonating element exhibits a resonance at a second frequency greater than the first frequency when the antenna is operated in free space, the resonance shifts to overlap the communications band at the first frequency when the antenna is loaded due to proximity to an object, and the shifted resonance reduces antenna efficiency in the communications band at the first frequency when the antenna is loaded relative to when the antenna is operated in free space; and a flexible printed circuit having opposing first and second surfaces, wherein the antenna resonating element is formed on the first surface and wherein the parasitic antenna resonating element is formed on the second surface.

2. The antenna defined in claim 1 wherein the parasitic antenna resonating element comprises an L-shaped parasitic antenna resonating element.

3. The antenna defined in claim 1 further comprising a molded plastic carrier, wherein the antenna resonating element comprises metal traces formed on the plastic carrier, and the parasitic antenna resonating element comprises metal traces formed on the molded plastic carrier.

4. The antenna defined in claim 1 wherein the antenna ground comprises a metal electronic device housing.

5. The antenna defined in claim 1 further comprising capacitive proximity sensor circuitry that is electrically coupled to the antenna resonating element.

6. An antenna operable in a communications band at a first frequency, comprising:

an antenna ground;

antenna resonating element, wherein the antenna resonating element comprises an inverted-F antenna resonating element;

a parasitic antenna resonating element, wherein the parasitic antenna resonating element exhibits a resonance at a second frequency greater than the first frequency when the antenna is operated in free space, the resonance shifts to overlap the communications band at the first frequency when the antenna is loaded due to proximity to an object, the shifted resonance reduces antenna efficiency in the communications band at the first frequency when the antenna is loaded relative to when the antenna is operated in free space, and the parasitic antenna resonating element comprises a metal trace; and an inductor coupled between the metal trace and the antenna ground.

7. An antenna operable in a communications band at a first frequency, comprising:

an antenna ground;

antenna resonating element, wherein the antenna resonating element comprises an inverted-F antenna resonating element;

a parasitic antenna resonating element, wherein the parasitic antenna resonating element exhibits a resonance at a second frequency greater than the first frequency when the antenna is operated in free space, the resonance shifts to overlap the communications band at the first frequency when the antenna is loaded due to proximity to an object, the shifted resonance reduces antenna efficiency in the communications band at the first frequency when the antenna is loaded relative to when the antenna is operated in free space, and the parasitic antenna resonating element comprises a metal trace; and a capacitor coupled between the metal trace and the antenna ground.

* * * * *